United States Patent [19]

Koike

[11] Patent Number: 4,693,668

[45] Date of Patent: Sep. 15, 1987

[54] TURBINE HOUSING OF TURBOCHARGER

[75] Inventor: Takaaki Koike, Hachioji, Japan

[73] Assignee: Ishikawajima-Harima Jukogyo Kabushiki Kaisha, Tokyo, Japan

[21] Appl. No.: 865,358

[22] Filed: May 21, 1986

[30] Foreign Application Priority Data

May 29, 1985 [JP] Japan ..... 60-80233[U]

[51] Int. Cl.[4] ..... F28F 7/00

[52] U.S. Cl. ..... 415/138; 415/187

[58] Field of Search ..... 415/203, 204, 205, 206, 415/187, 188, 189, 219 R, 219 C, 134, 136, 138, 139, 184, 185

[56] References Cited

U.S. PATENT DOCUMENTS

| | | | |
|---|---|---|---|
| 2,801,043 | 7/1957 | Spotz et al. | 415/205 |
| 2,944,785 | 7/1960 | Sampietro | 415/102 |
| 3,270,495 | 9/1966 | Connor | 415/205 |
| 3,331,302 | 7/1967 | Baumann et al. | 415/219 R |
| 3,394,919 | 7/1968 | Catterfeld | 415/138 |
| 4,384,821 | 5/1983 | Mains et al. | 415/136 |

*Primary Examiner*—Robert E. Garrett
*Assistant Examiner*—John Kwon

[57] ABSTRACT

Mated engaging grooves are formed at opposing surfaces of sections into which a turbine housing main body is divided with respect to the axial direction of a turbine. A partition wall is fitted in the mated engaging grooves, leaving a clearance in the radial direction. The end of the partition wall on the side of the gas inlet of the turbine housing main body is made into contact with the side surface or surfaces of a partition wall supporting member disposed at the gas inlet such that the partition wall supporting member is in coplanar relationship with a flange surface of the turbine housing main body, whereby thermal deformations in the direction of the gas flow at the gas inlet of the partition wall are permitted and the gas-tightness is ensured at the gas inlet of the turbine housing.

1 Claim, 8 Drawing Figures

TURBINE HOUSING OF TURBOCHARGER

BACKGROUND OF THE INVENTION

The present invention relates to a turbine housing of a turbocharger of the type in which a passage through which exhaust gases are charged into a turbine is partitioned into a plurality of paths.

A typical conventional turbine housing with a construction as shown in FIGS. 5 and 6 has a turbine housing main body 1 and a partition wall 4 formed integral therewith so that thermal stresses produced in the partition wall 4 become excessive and cracks tend to propagate from the leading end of the partition wall 4 due to the thermal fatigue and consequently the partition wall 4 is broken, losing its function. Especially when the exhaust gases do not flow through a plurality of scrolls simultaneously, the temperature difference between them becomes so high that the service life of the partition wall 4 is considerably shortened.

In order to overcome the above-described problem, there has been proposed an improved divided-type turbine housing as shown in FIG. 7 in which an independent partition wall 4 is joined to a turbine housing main body 1 so as to decrease thermal stresses produced. The turbine housing main body less restricts the thermal deformations of the partition wall 4 so that the life of the partition wall 4 can be prolonged.

However, in the turbine housing of the type shown in FIG. 7, the partition wall 4 is loosely fitted into mated engaging grooves on the turbine housing main body 1 so that the freedom of thermal deformation is enhanced. As a result, due to thermal influences, the partition wall 4 deforms itself in the radial direction and simultaneously contracts or expands in the peripheral or circumferential direction. Therefore, as shown in FIG. 8, when the wound end which less influences the performance of the partition wall 4 is terminated into a fixed portion 3, the position of the partition wall 4 at the gas inlet may vary, leaving a space $\Delta l$. As a result, there results a problem that the exhaust gases may be mixed at the flange portion in the gas inlet. Furthermore, there arises a problem that the end of the partition wall 4 may extend beyond the flange surface, causing the deformations of the partition wall or damaging a gasket at the gas inlet. Similar problems are observed in the turbine housing of the type in which the wound end of the partition wall is not separated because the thermal expansion corresponding to the length of the partition wall occurs at the gas inlet.

In view of the above, one of the objects of the present invention is to prevent the mixture of exhaust gases at the flange portion in the gas inlet.

The above and other objects, effects, features and advantages of the present invention will become more apparent from the following description of a preferred embodiment thereof taken in conjunction with the accompanying drawings.

DETAILED DESCRIPTION OF THE PREFERRED EMBODIMENT

Figure 1:
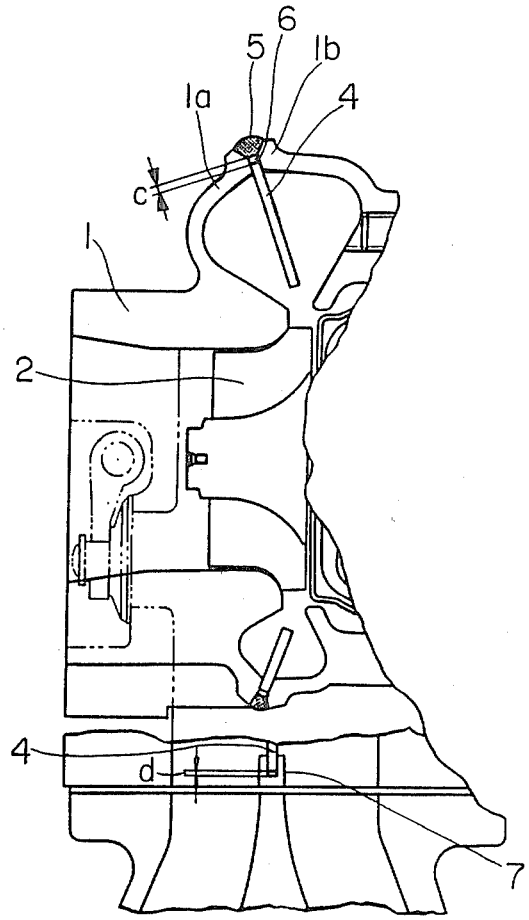
FIG. 1 is a longitudinal sectional view of a preferred embodiment of the present invention.

FIG. 1 shows a preferred embodiment of the present invention in which a turbine housing main body 1 is divided into divided turbine housing main bodies 1*a* and 1*b* with respect to the axial direction of a turbine 2. Engaging grooves 6 are formed in the opposing surfaces of the turbine housing main bodies 1*a* and 1*b*. The outer peripheral portion of a partition wall 4 is fitted into the mated engaging grooves 6 with a small clearance c being provided between the bottom of the grooves 6 and the outer periphery of the wall 4. Outer peripheral portions 5 of the opposing surfaces of the turbine housing main bodies 1*a* and 1*b* are securely joined to each other by welding, brazing or by means of bolts and nuts.

Figure 2:
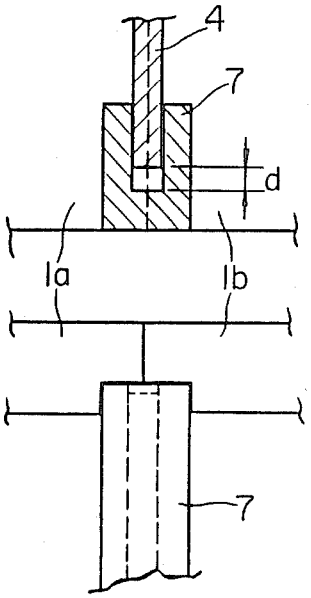
FIGS. 2 and 3 are views used to explain joints between a partition wall and a partition wall supporting member, respectively.
Figure 3:
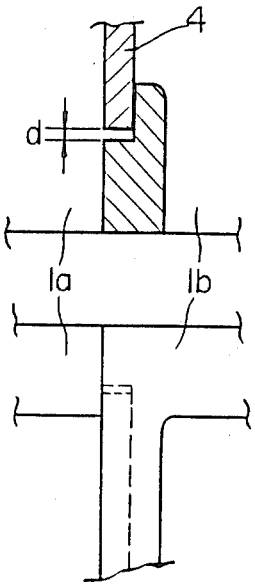
Figure 4:
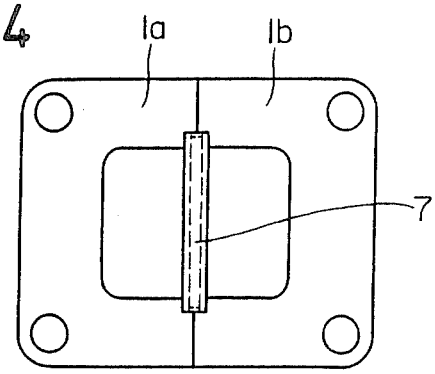
FIG. 4 is a view used to explain a gas inlet.
Figure 5:
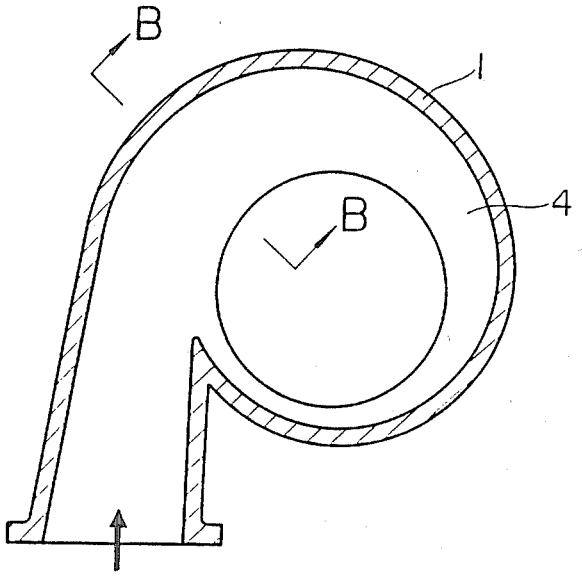
Fig.5 PRIOR ART
FIG. 5 is a view used to explain a conventional turbine housing.
Figure 6:
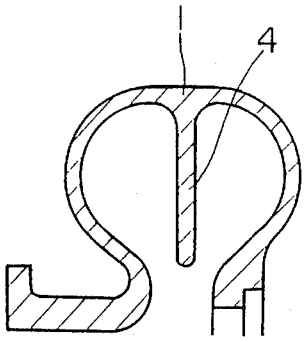
Fig.6 PRIOR ART
FIG. 6 is a sectional view taken along the line B—B of FIG. 5.
Figure 7:
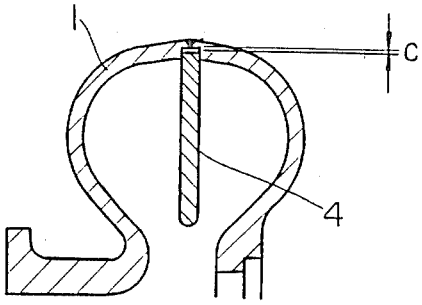
Fig. 7 PRIOR ART
FIG. 7 is a view used to explain an improved conventional turbine housing and taken along the line C—C of FIG. 8.
Figure 8:
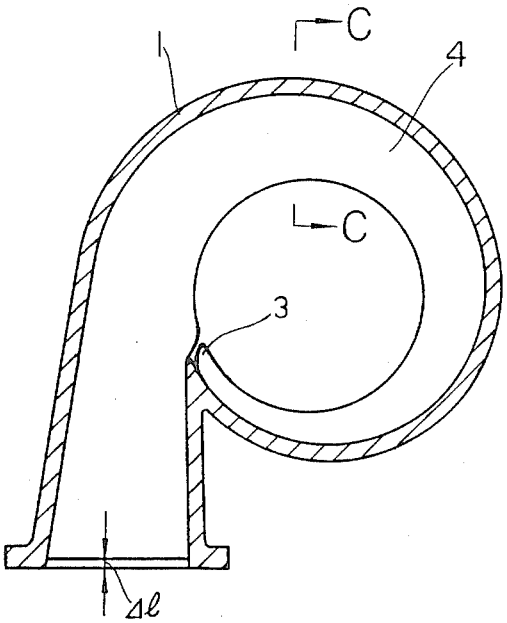
Fig. 8 PRIOR ART
FIG. 8 is a longitudinal sectional view of the improved conventional turbine housing shown in FIG. 7.

A partition wall supporting member 7 is joined integral with the turbine housing main body 1 at its gas inlet by welding or by fitting the partition wall supporting member 7 into the groove of the turbine housing main body 1 such that the partition wall supporting member is in coplanar relationship with the flange surface of the turbine housing main body 1. As shown in FIG. 2 or 3, one or both sides surfaces of the partition wall 4 are made into contact with the partition wall supporting member 7. A small clearance d is provided between the partition wall supporting member 7 and the peripheral end or edge of the partition wall 4.

In operation of the turbocharger, the partition wall 4 is exposed to high temperature gase and is thermally expanded. But there are provided a clearance c in the radial direction and a clearance d in the circumferential direction so that the partition wall 4 is not restricted and consequently no excessive thermal stresses are produced.

Furthermore, the side surfaces of the partition wall 4 are made into contact with the partition wall supporting member 7 at the gas inlet and the supporting member 7 is so arranged as to be in coplanar relationship with the flange surface of the housing main body 1 so that the gases flowing through the scrolls are prevented from being mixed and consequently the performance of the turbocharger is much enhanced.

According to the present invention, the turbine housing main body is divided into a plurality of sections with respect to the axial direction of the turbine and the partition wall is fitted into the mated engaging grooves formed in the opposing surfaces of the divided turbine housing main bodies or sections, leaving a clearance in the radial direction of the partition wall. As a consequence, the thermal deformation in the radial direction of the partition wall is permitted so that the partition wall is prevented from being cracked and consequently the safety of the turbine housing can be ensured. Furthermore, the side surfaces of the partition wall are made in contact with the gas inlet of the turbine housing, leaving a clearance in the circumferential direction of the partition wall. In addition, the partition wall supporting member is so arranged as to be in coplanar relationship with the flange surface of the turbine housing at the gas inlet. Therefore, the gas-tightness can be ensured at the gas inlet of the turbine housing and the performance of the turbocharger can be enhanced.

What is claimed is:

1. A turbine housing of a turbocharger of the type in which an interior of a turbine housing main body is partitioned into a plurality of paths, comprising: a turbine housing main body divided into a plurality of sections in axial direction of the turbine, mated engaging grooves formed in an inner circumferential direction at opposing surfaces of the divided sections of said turbine housing, a partition wall fitted into said engaging grooves, leaving a clearance in radial direction of the turbine, said partition wall having side surfaces, and a partition wall supporting member which integrally joins opposing surfaces of said divided sections of said turbine housing main body and which is disposed in said turbine housing main body such that said partition wall supporting member is in coplanar relationship with a flange surface of said turbine housing main body at a gas inlet and contacts at least one side surface of said partition wall, so as to ensure gas-tightness at said gas inlet in gas flow direction, leaving a predetermined clearance in circumferential direction of said partition wall.

* * * * *